US006185868B1

(12) United States Patent
Kato

(10) Patent No.: US 6,185,868 B1
(45) Date of Patent: Feb. 13, 2001

(54) AUTOMATIC CLOSER OF POP-UP DOOR OF VEHICLE

(75) Inventor: Kenji Kato, Kariya (JP)

(73) Assignee: Toyota Shatai Kabushiki Kaisha, Kariya (JP)

( * ) Notice: Under 35 U.S.C. 154(b), the term of this patent shall be extended for 0 days.

(21) Appl. No.: 08/931,307

(22) Filed: Sep. 16, 1997

(30) Foreign Application Priority Data

Sep. 26, 1996 (JP) ..... 8-277036
Sep. 27, 1996 (JP) ..... 8-277588

(51) Int. Cl.[7] ..... E05F 11/24

(52) U.S. Cl. ..... 49/339; 49/340; 192/35; 296/56

(58) Field of Search ..... 49/139, 360, 339, 49/340, 324, 349; 192/35, 42; 296/146.4, 146.8, 56

(56) References Cited

U.S. PATENT DOCUMENTS 4,429,264 * 1/1984 Richmond ..... 318/466
4,881,018 * 11/1989 Kato et al. ..... 49/349
5,107,972 * 4/1992 Sundquist ..... 192/35
5,147,106 * 9/1992 Bartelt et al. ..... 296/202
5,348,126 * 9/1994 Gao ..... 192/7
5,448,856 * 9/1995 Moore et al. ..... 49/340
5,531,498 * 7/1996 Kowall ..... 296/146.4
5,588,258 * 12/1996 Wright et al. ..... 49/340
5,755,059 * 5/1998 Schap ..... 49/360
5,787,636 * 8/1998 Buchanan, Jr. ..... 49/360
5,806,246 * 9/1998 Azuma ..... 49/360
5,851,050 * 12/1998 Squire et al. ..... 49/140
5,896,703 * 4/1999 Wright et al. ..... 49/339

FOREIGN PATENT DOCUMENTS 5-52165 7/1993 (JP) .

* cited by examiner

*Primary Examiner*—Daniel P. Stodola
*Assistant Examiner*—Curtis A. Cohen
(74) *Attorney, Agent, or Firm*—Pillsbury Madison & Sutro LLP

(57) ABSTRACT

A connection wire is connected to a part of a rear door popped up in a door-opening direction by an urging force. A pulley rotates responsive to a driving motor inside a wire-winding device to wind the connection wire thereon. In this manner, the rear door is automatically closed. The pulley is urged in a connection wire-winding direction by a power spring. A clutch is between the pulley and the driving motor. When the rear door is pressed by an operator's hands in a door-closing direction while the rear door is being closed, the pulley is rotated by the power spring, thus winding the connection wire thereon and preventing the connection wire from becoming loose. At this time, the connection between the pulley and the driving motor is cut off by the clutch. Thus, the pulley is rotated by the power spring freely and rapidly. In this manner, the rear door can be closed manually even while it is being closed automatically. Further, the connection wire can be prevented from becoming loose and from being sandwiched between the body of the vehicle and the periphery of a rear opening thereof.

16 Claims, 15 Drawing Sheets

AUTOMATIC CLOSER OF POP-UP DOOR OF VEHICLE

CROSS-REFERENCE TO RELATED APPLICATIONS

This application is related to Japanese Patent Application Nos. Hei 8-277036 and 8-277588, incorporated herein by reference.

BACKGROUND OF THE INVENTION

1. Field of the Invention

The present invention generally relates to an automatic closer of a pop-up door of a vehicle, and more particularly to an automatic closer for allowing the pop-up door of the vehicle to perform a closing operation by winding a connection wire.

2. Description of Related Art

Normally, the upper end of a pop-up rear door of a van is connected to the upper side of the rear opening of the body by a hinge. A gas damper is at the upper side of the rear opening of the body to allow an operator to press the rear door upward using a reduced amount of force. Thus, after the upward movement of the rear door is started, the rear door is pressed upward by the extension force of the damper. When the rear door is popped up at the maximum angle, the lower edge of the rear door is so high that a short person must stretch up to grasp the lower edge of the rear door to close it. In addition, great force is required to swing the rear door downward against the press-up force of the damper.

In order to solve the above-described problem, an apparatus for automatically closing the pop-up rear door by winding a wire connected to the rear door and to a wire-winding device by driving a motor is disclosed in Japanese Utility Model Publication No. Hei 5-52165. This kind of automatic closer has problems in that the wire is sandwiched between the rear door and the periphery of the rear opening of the vehicle body while the automatic closer is operating; that the driving motor for driving the wire-winding device must be large to apply sufficient tension to the wire; and that the rear door is closed at varying speeds.

SUMMARY OF THE INVENTION

In view of the above problems of the prior art, it is a first object of the present invention to provide an automatic closer of a pop-up door of a vehicle which prevents a connection wire from being sandwiched between a rear door and the side edge of a rear opening of a vehicle body while the automatic closer is operating by preventing the connection wire from becoming loose, and which allows manual closing of the rear door to be accomplished.

It is a second object of the present invention to provide an automatic closer of a pop-up door of a vehicle which eliminates the need for a large driving motor for driving a connection wire-winding device and which allows the door to be closed with a smallest possible speed variation.

In order to achieve the objects, a first aspect of the present invention provides an automatic closer of a pop-up door of a vehicle which includes a door to be urged in a door-opening direction; a connection wire, one end of which is connected to a portion of the door; a pulley for winding the connection wire thereon; a driving device driving the pulley; and a spring member urging the pulley in a wire-winding direction.

In this construction, when the door is pressed downward to pivot it rapidly in the closing direction while the door is being swung downward via the connection wire by driving the driving device to wind the connection wire on the pulley, the connection wire will be loosened. At this time, the pulley being urged by the spring member rotates at high speed in the winding direction, thus winding the connection wire thereon. Thus, the connection wire can be prevented from being loosened. When the door pivots downward rapidly by its own weight immediately before the door is completely closed, the construction prevents the connection wire from being loosened.

The above objects are achieved according to a second aspect of the present invention by providing an automatic closer of a pop-up door of a vehicle which includes a clutch between the pulley and the driving device which allows free rotation of the pulley when the driving device is not in operation and which restricts the rotation of the pulley relative to the driving device in a wire-feeding direction when the driving device is in operation.

In this construction, the number of rotations of the driving device is almost constant when it is in operation, and the pulley is subjected to a force in a connection wire-feeding direction in the greater part of the rear door-closing process when the automatic closer is performing the door-closing operation. Accordingly, the rotation of the pulley relative to the driving device is restricted by the clutch, thus rotating with the driving device and winding the connection wire thereon at a constant speed. In this manner, the door-closing operation is performed. When the door being closed is pressed downward by an operator's hand to swing the door rapidly downward, the spring member applies a force of connection wire-winding direction to the pulley. Therefore, the clutch does not operate and the pulley rotates freely and rapidly in the connection wire-winding direction, thus winding the connection wire thereon at high speed and preventing it from being loosened. When the driving device is not in operation, the pulley is capable of rotating freely, thus allowing the door to be opened and closed freely.

The above objects are achieved according to a third aspect of the present invention by providing an automatic closer of a pop-up door of a vehicle which includes a rotation detection device detecting that the pulley has started to rotate in a wire-winding direction. The driving device starts to operate when the rotation detection device detects that the pulley has started to rotate.

In this construction, when the opened door is pressed downward by an operator's hands to swing it in the closing direction, the pulley being urged by the spring member starts to rotate. Thus, the connection wire can be prevented from being loosened. The rotation detection device detects that the pulley has started to rotate, thus outputting a signal to a motor control circuit. Upon receipt of the signal, the driving motor starts, thus actuating the pulley. In this manner, the door is automatically closed. This construction eliminates the need for the provision of an instruction switch and allows an operator to close the door automatically.

The above objects are achieved according to a fourth aspect of the present invention by providing an automatic closer of a pop-up door of a vehicle which includes a door to be urged in a door-opening direction; a connection wire, one end of which is connected to a portion of the door; a wire-winding device for winding the connection wire thereon; and a guide member which guides the connection wire in a direction divergent from a linear locus of the connection wire when a tensile force is not applied to the connection wire in a wire-winding operation and which is elastically deformed along the linear locus of the connection wire when the tensile force is applied. It is preferable that the guide member extends in a direction away from the periphery of the rear opening of the vehicle body.

In this construction, when the door is closed, the connection wire is wound by the wire-winding device. At this time, a tensile force is applied to the connection wire and the guide member is elastically deformed, thus moving to the linear locus of the connection wire. When the door pivots downward rapidly by its own weight immediately before the door is completely closed, the wire-winding device is incapable of winding the connection wire in a short period of time because the wire-winding device winds it at a constant speed. Thus, the connection wire will be loose. At this time, the tensile force is not applied to the connection wire. As a result, the guide member is restored to its original shape, thus guiding the connection wire in the direction divergent from the linear locus. As a result, the connection wire is deflected and thus can be prevented from being loosened. Because the guide member is elastically restored to its original shape at high speed, the connection wire can be effectively prevented from becoming loosened, and can be prevented from being sandwiched between the door and the periphery of the rear opening of the vehicle body.

The above objects are achieved according to a fifth aspect of the present invention by providing an automatic closer of a pop-up door of a vehicle which includes a door which is connected to an upper periphery of an opening of a vehicle body by a hinge and which can be popped up; a damper between the door and the vehicle body so that the damper forms an angle with the vehicle body to form a triangle having a top angle at a hinge-connected portion of the door, thus popping up the door in a door-opening direction by an extension force thereof; a connection wire, one end of which is connected to a portion of the door; a wire-winding device on the vehicle body which winds the connection wire; and a guide member on a periphery of an opening of the vehicle body which guides the connection wire from the periphery of the opening to the door so that the connection wire forms an angle with the vehicle body which is greater than the angle formed by the damper with the vehicle body to form a triangle having a top angle at the hinge-connected portion of the door to suppress fluctuation in a wire-pulling force of the wire-winding device.

It is preferable that the ratio between two sides of the triangle, namely, the ratio of the length between the hinge-connected position and the guide member to the length between the hinge-connected position and the connection wire-connected position, is set to 1:1–4:3.

In this construction, the guide member guides the connection wire from the periphery of the opening to the door so that the connection wire forms the angle with the vehicle body which is greater than the angle formed by the damper with the vehicle body to form a triangle having a top angle at the hinge-connected portion of the door. Therefore, in the process of closing the door, the fluctuation in the distances between the hinge-installed position and the action line of a wire-pulling force can be restricted to a small range. Therefore, the wire-pulling force does not rapidly become great against the door opening moment of the damper while the rear door is downwardly swinging. Therefore, the driving motor need not be large; further, the door-closing speed can be prevented from fluctuating greatly.

Other objects and features of the present invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

An automatic closer of a pop-up door of a vehicle according to a first preferred embodiment of the present invention will be described below with reference to the drawings.

Figure 1:
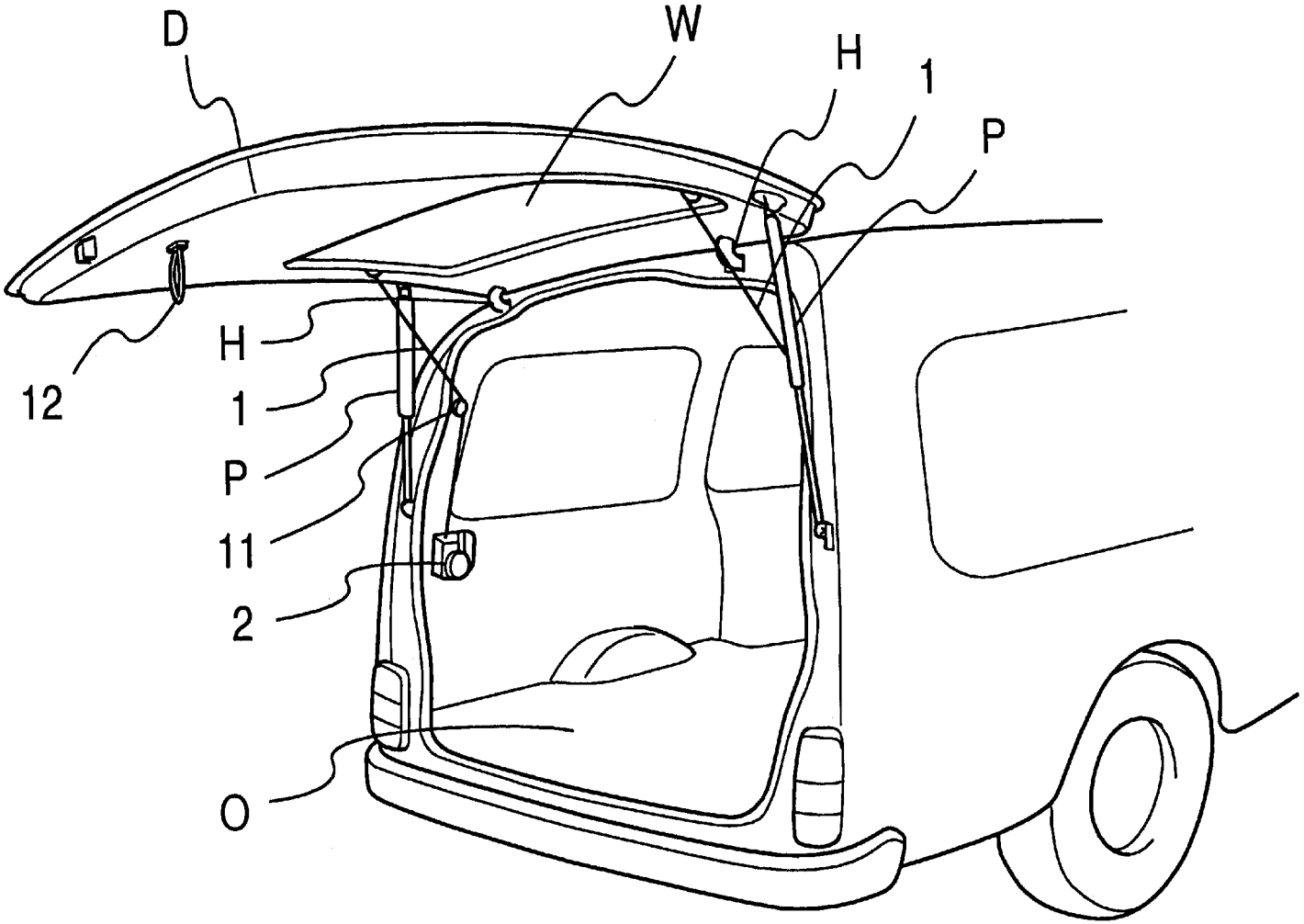
FIG. 1 is a perspective view of a popped up rear door of a van having an automatic closer according to a first preferred embodiment of the present invention.
Figure 2:
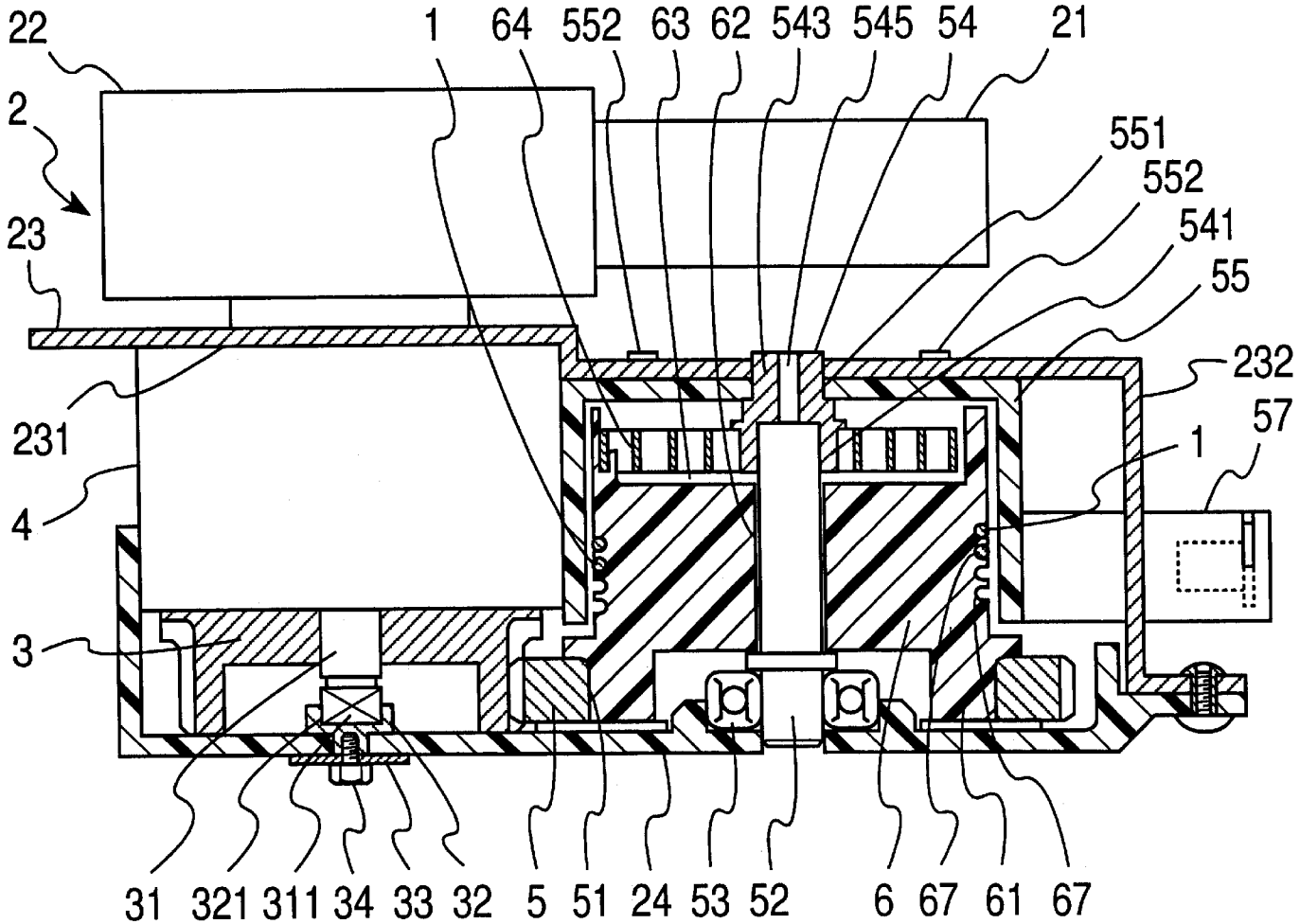
FIG. 2 is a partial cross-sectional side view of a wire-winding device according to the first embodiment.

FIG. 1 is a perspective view showing a rear part of a van. A pop-up rear door (D) is on the rear part of the body of the van to close a rear opening (O) of the body of the van. In the state shown in FIG. 1, the rear door (D) has been popped up. The rear door (D) is connected to the rear part of the body by a pair of hinges (H) respectively at the left-hand and right-hand sides of the rear upper part of the body. A pair of dampers (P) are between the rear door (D) and the rear part of the body to support the rear door (D) popped up by the extension force thereof. One end of the left-hand dampers (P) is mounted on the left-hand edge of the upper part of the rear door (D) and the other end thereof is mounted on the left-hand edge of the rear part of the body, whereas one end of the right-hand dampers (P) is mounted on the right-hand edge of the upper part of the rear door (D) and the other end thereof is mounted on the right-hand edge of the rear part of the body. One end of a left-hand connection wire 1 is connected to the left-hand edge of the rear door (D) proximate to a rear windshield (W) formed on the rear door (D) and the other end thereof is connected to a wire-winding device 2 installed on the inner surface of the left-hand side wall of the body, whereas one end of right-hand connection wire 1 is connected to the right-hand edge of the rear door (D) proximate to the rear windshield (W) and the other end thereof is connected to a wire-winding device (not shown) installed on the inner surface of the right-hand side wall of the body, with both connection wires 1 supported by a corresponding guide roller 11 (only one of the two rollers 11 is shown in FIG. 1) proximate to the periphery of the opening (O). A switch 12 for closing the rear door (D) is in the vicinity of the lower end of the inner side of the rear door (D). The switch 12 is connected to a control circuit (not shown).

Figure 3:
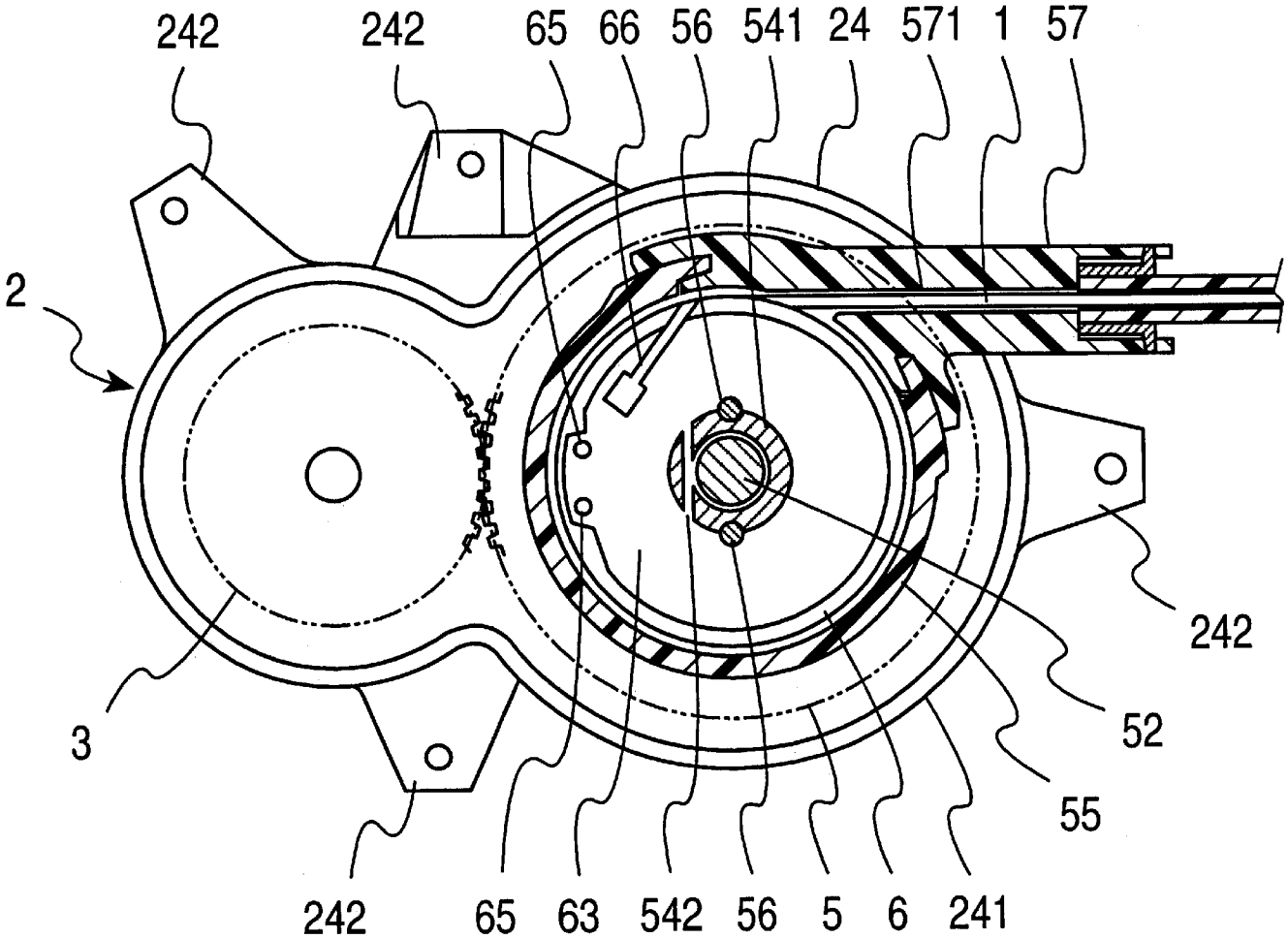
FIG. 3 is a partial cross-sectional plan view of the wire-winding device according to the first embodiment.
Figure 4:
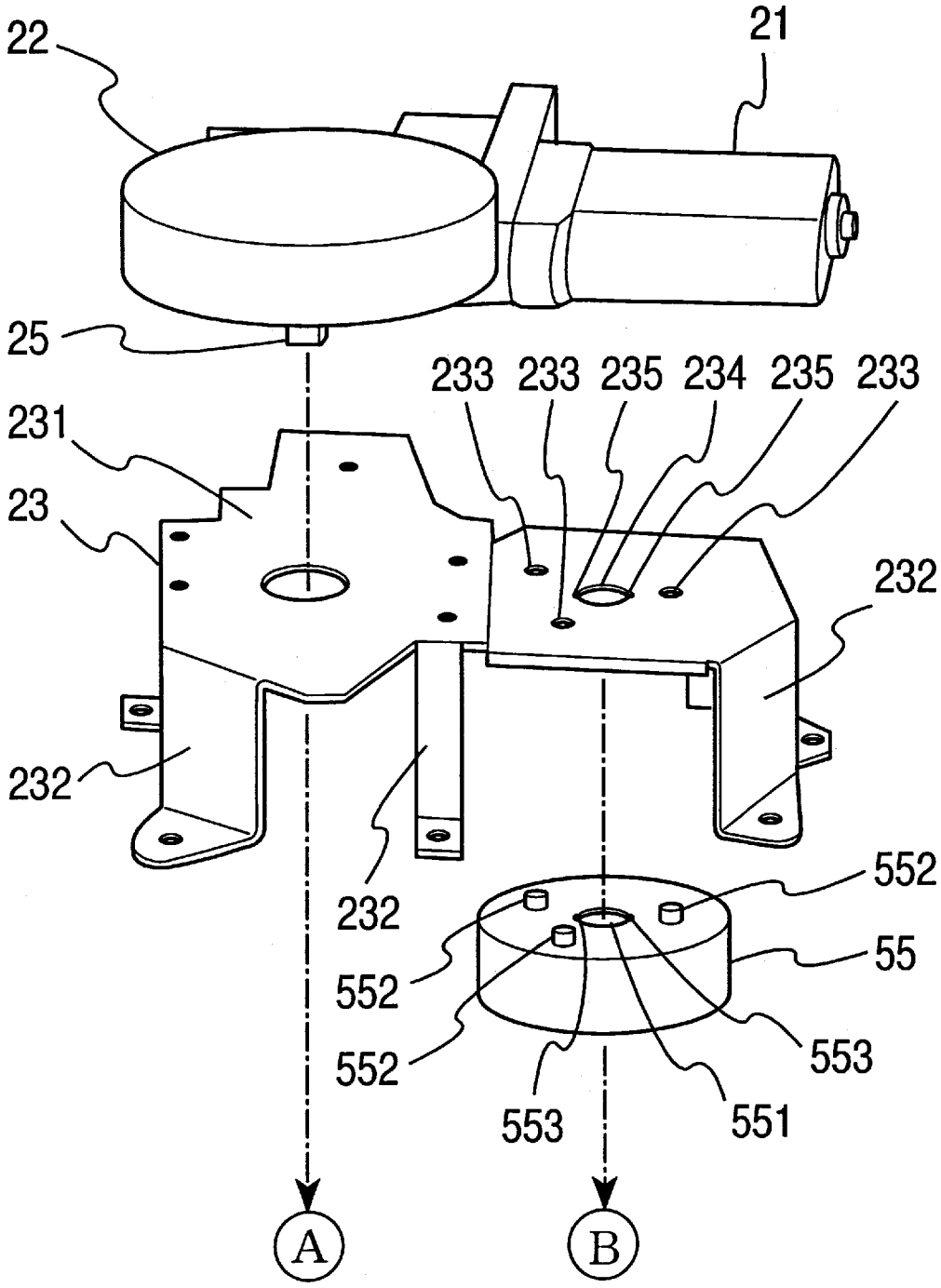
FIGS. 4 and 5 are partial exploded perspective views of the wire-winding device according to the first embodiment.

FIGS. 2 through 5 show the detailed construction of a wire-winding device 2 including a motor section and a wire-winding section. The motor section has a driving motor 21 and a reduction gear-accommodating box 22 on the side of the output shaft thereof. With reference to FIG. 4, the reduction gear box 22 is fixed to the upper side of a supporting frame 23. The supporting frame 23 is formed from a pressed metal plate and includes a ceiling plate 231 on which the reduction gear box 22 is mounted and multiple legs 232 on the periphery of the ceiling plate 231. The lower end of each leg 232 is connected to the periphery of a base 24 (see FIG. 2). The base 24 is a container (see FIG. 3) gourd-shaped in a plan view and has a wall 241 having an appropriate height which is in the periphery of the container. Multiple mounting stays 242 project from the periphery of the wall 241.

Figure 5:
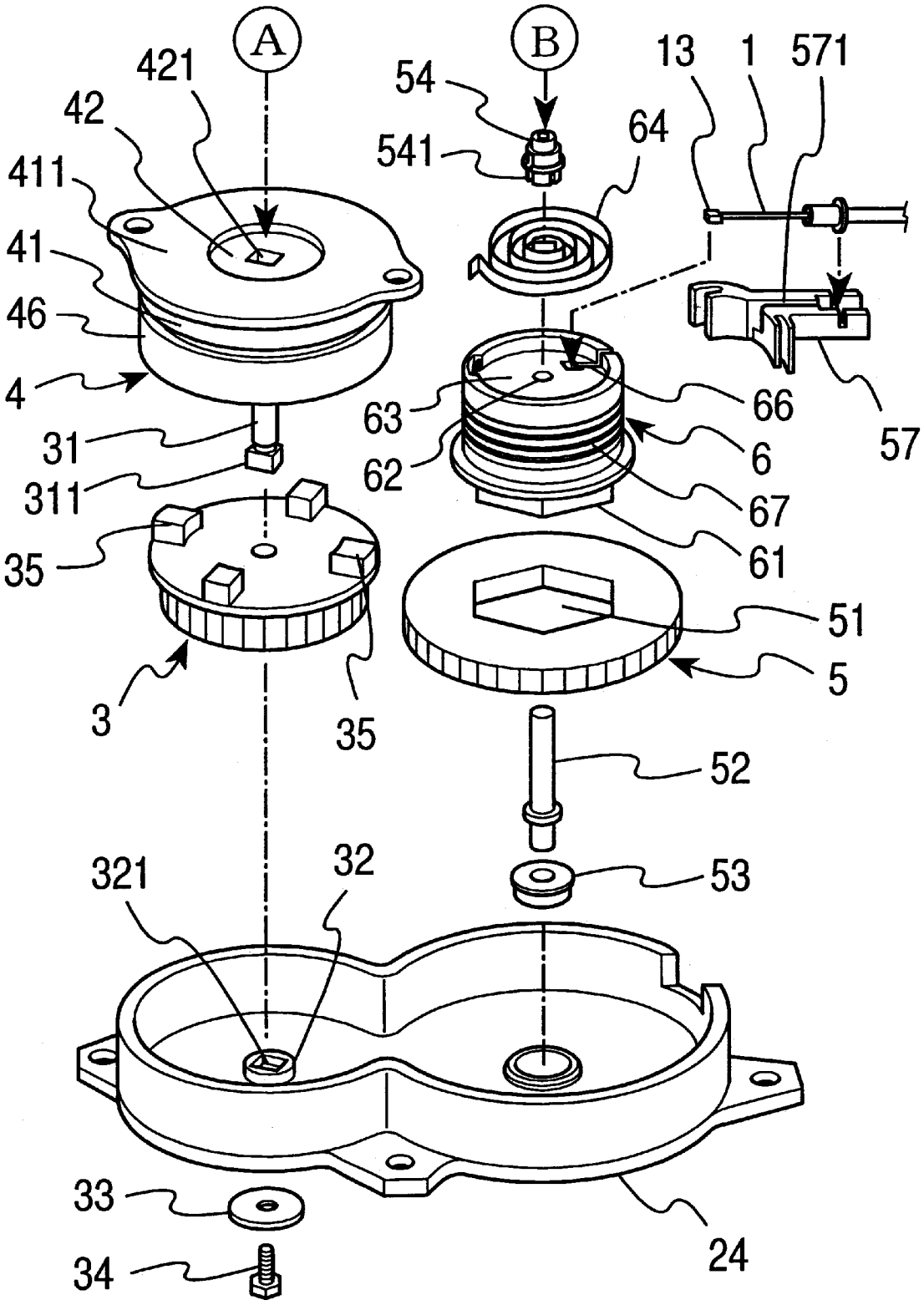

A gear 3 is accommodated in a small-diameter circular portion of the base 24. The center of the gear 3 is rotatably supported by a shaft 31 (see FIG. 2.) The lower end 311 of the shaft 31 is rectangular and inserted into a rectangular recess 321 in a bearing 32 on the bottom surface of the base 24 (see FIGS. 2 and 5). The bearing 32 is fixed to the base 24 by a screw 34 inserted into the recess 321 through a washer 33 from the underside of the base 24. As shown in FIG. 5, four engaging projections 35 are on the periphery of the upper surface of the gear 3. As will be described later, the gear 3 is connected to a clutch 4 (see FIG. 5) above the gear 3 through the engaging projections 35. The clutch 4 is fixed to the ceiling plate 231 of the supporting frame 23 by fixing flanges 411 on the periphery of the upper surface of its cover 41 to the lower surface of the ceiling plate 231 with screws. A rectangular portion 25 (see FIG. 4) of the out put shaft of the reduction gear box 22 projecting downward from the center of the lower surface thereof is fixedly inserted into a rectangular recess 421 at the center of the upper surface of the upwardly open input shaft 42 (see FIG. 5) of the clutch 4.

Referring to FIG. 3, a large-diameter gear 5 engaging the gear 3 is in the large-diameter part of the base 24. The gear 5 is connected to a pulley 6 by downwardly inserting a hexagonal lower end 61 of the pulley 6 into a rectangular opening 51 (see FIG. 5) at the center of the gear 5. A shaft 52 (see FIG. 5) is inserted into a center through-hole 62 of the pulley 6. The lower end of the shaft 52 is supported on the lower surface of the base 24 through a bearing 53. The upper end of the shaft 52 is inserted into a cylindrical lower part 541 of a shaft member 54 serving as a supporting member. A power spring 64 is accommodated in an inner part 63 recessed from the periphery of the upper surface of the pulley 6.

The detailed construction of the power spring 64 is described below with reference to FIG. 6. The outer end of the power spring 64 is bent and held by a pair of pins 65 on the peripheral edge of the inner part 63 of the power spring 64, whereas the inner end of the power spring 64 is bent and locked in a linear groove 542 on the lower cylindrical part 541 of the shaft member 54. An upper cylindrical part 543 of the shaft member 54 is inserted into a center opening 551 of a pulley guide 55 (see FIGS. 2 and 4) covering the periphery of the pulley 6 and the upper part thereof. Three projections 552 (see FIG. 4) formed on the upper surface of the pulley guide 55 are inserted into respective mounting holes 233 on the ceiling plate 231 of the supporting frame 23 and fixed thereto by caulking.

Figure 6:
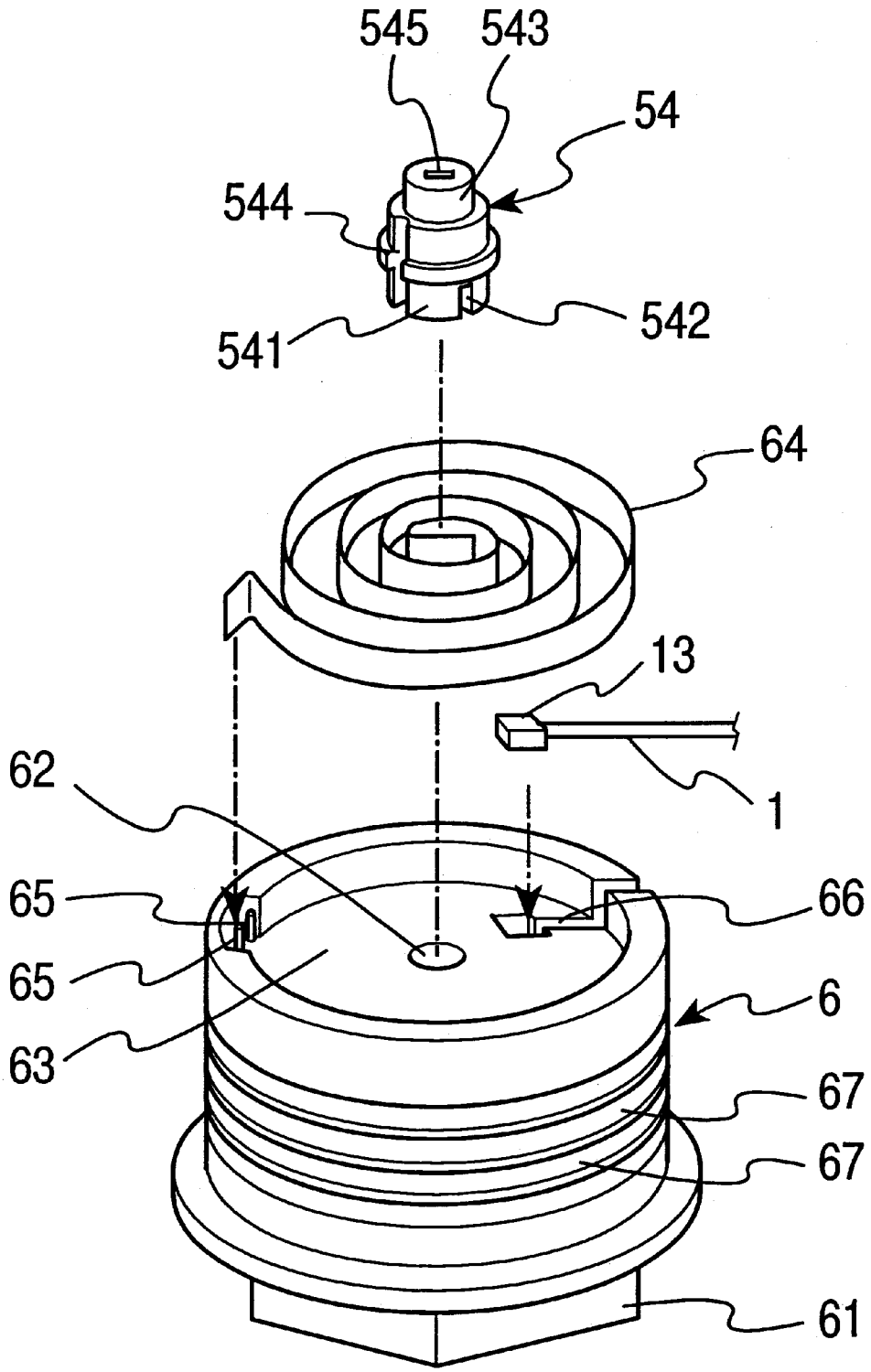
FIG. 6 is an exploded perspective view of the wire-winding device according to the first embodiment.

Two cut-outs 544 semicircular in a plan view are formed on the peripheral wall of the shaft member 54 so the cut-outs 544 are symmetrical with respect to the center of the shaft member 54 (only one cut-out 544 is shown in FIG. 6). In order to stop the rotation of the shaft member 54, pins 56 (see FIG. 3) are inserted into circular spaces formed by the cut-outs 544; cut-outs 235 on the inner peripheral edge of an opening 234 on the ceiling plate 231 of the supporting frame 23 (see FIG. 4); and cut-outs 553 (see FIG. 4) on the inner peripheral edge of the center opening 551 on the pulley guide 55.

As shown in FIG. 3, a cut-out is on a part of the peripheral wall of the pulley guide 55 (see FIG. 5.) One end of a wire guide member 57 (see FIG. 5) is fixedly inserted into the cut-out. A connection wire 1 extending from the rear door (D) is inserted into a center groove 571 of the wire guide member 57. A rectangular locking strip 13 (see FIG. 6) positioned at the front end of the connection wire 1 is fixedly inserted into a locking groove 66 on the inner part 63 of the pulley 6. Referring to FIGS. 3 and 6, the connection wire 1 is wound into a spiral groove 67 on the peripheral surface of the pulley 6 by rotating the pulley 6 counterclockwise. When the pulley 6 is rotated clockwise by feeding the connection wire 1 forward from the spiral groove 67, the power spring 64 is tightened and deformed, i.e., the power spring 64 is wound tightly around the shaft member 54, thus generating an urging force for rotating the pulley 6 counterclockwise. In order to impart an initial urging force to the power spring 64, with the connection wire 1 wound on the pulley 6, the pins 56 (see FIG. 3) are removed from the circular space and the front end of a screwdriver or other appropriate tool is inserted into a groove 545 on the upper surface of the shaft member 54 (see FIG. 6); the shaft member 54 is rotated at an appropriate angle to wind the power spring 64 tightly around the shaft member 54; the pins 56 are inserted into the circular space; and the shaft member 54 is placed in position again.

Figure 7:
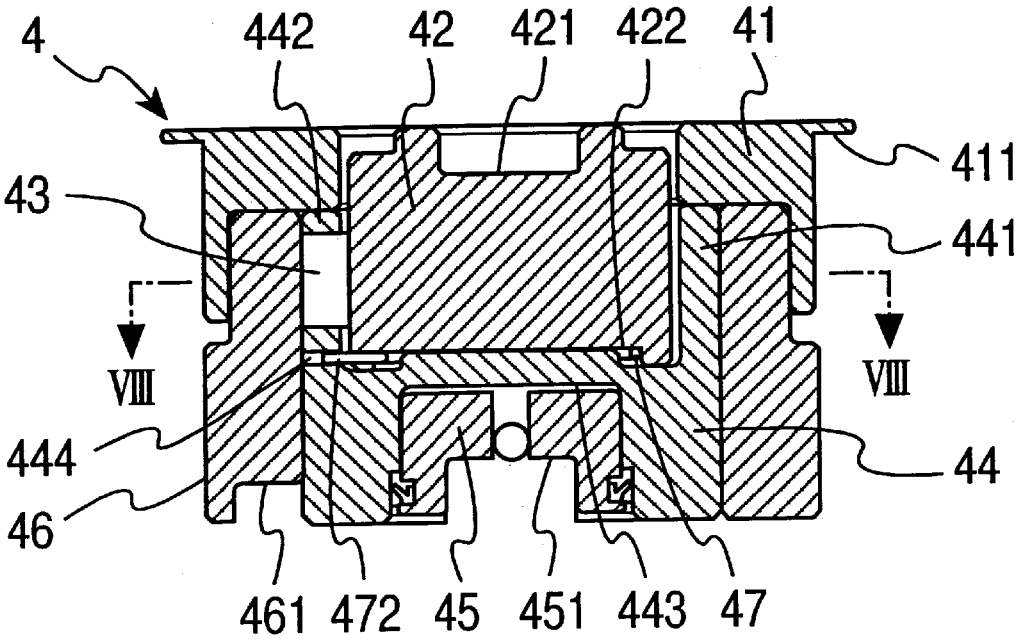
FIG. 7 is an axial cross-sectional view of the entire clutch according to the first embodiment, taken along line VII—VII of FIG. 8.
Figure 8:
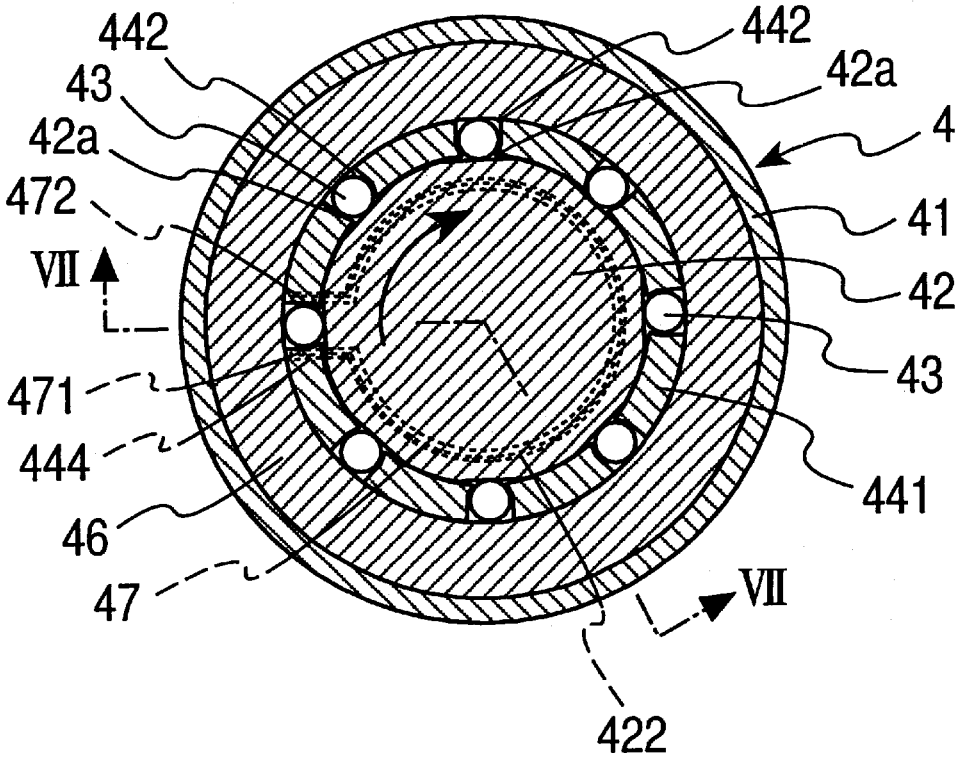
FIG. 8 is a radial cross-sectional view of the entire clutch according to the first embodiment, taken along line VIII—VIII of FIG. 7.
Figure 9:
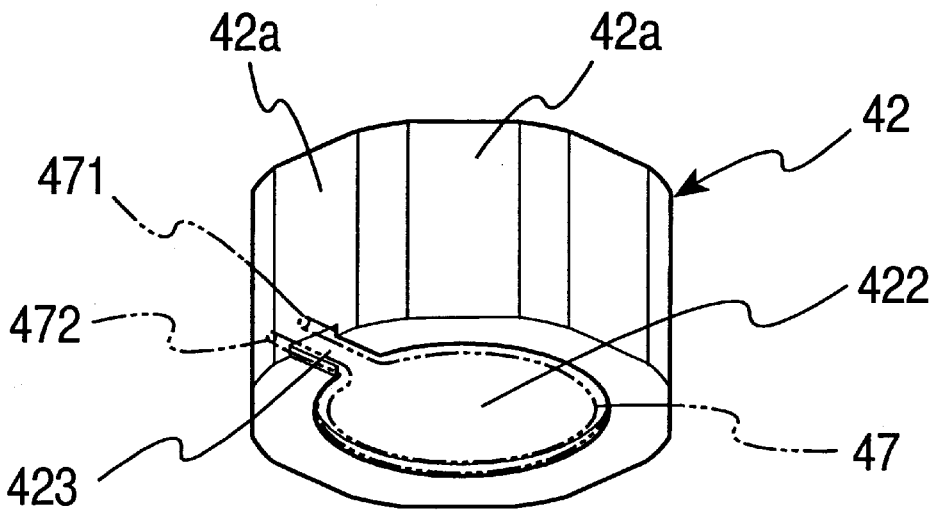
FIG. 9 is a perspective view of an input shaft according to the first embodiment.

Referring to FIG. 7, the input shaft 42 is positioned at the center of the cover 41, as described above. The rectangular portion 25 of the output shaft of the reduction gear box 22 (see FIG. 4) projecting from the center of the underside thereof is fitted in the rectangular recess 421 at the center of the upper surface of the input shaft 42 of the clutch 4. As shown in FIG. 8, eight peripheral planes 42*a* are on the cylindrical surface of the input shaft 42 at regular intervals. A roller 43 is in contact with the center of each of the peripheral planes 42*a* in the circumferential direction thereof. Each roller 43 is in a corresponding holding groove 442 formed on a cylindrical wall 441 of the holding member 44 (see FIG. 7) at regular intervals. As shown in FIG. 9, the circular inner part of the bottom surface of the input shaft 42 is recessed by a predetermined amount to form a circular recess 422 radially partially open to the outside. As shown in FIGS. 8 and 9, a ring-shaped spring 47 is mounted in the recess 422. The spring 47 is cut off at a circumferential portion thereof and both straight ends 471 and 472 of the spring 47 project radially outwardly through an opening 423 of the recess 422, thus penetrating into a through-hole 444 under one of the holding grooves 442 of the holding member 44, as shown in FIGS. 7 and 8. The inner diameter of the through-hole 444 is nearly the same as the distance between the ends 471 and 472 of the spring 47.

Referring to FIG. 7, the cylindrical wall 441 of the holding member 44 accommodates the input shaft 42. A bearing 45 is fitted in a circular recess 443 at the center of the lower surface of the bottom wall of the holding member 44. The upper end of the shaft 31 (see FIGS. 2 and 5) is fitted into a recess 451 on the lower surface of the bearing 45. An output outer ring 46 (see FIGS. 7 and 8) is positioned between the holding member 44 and the cover 41 so the inner peripheral surface of the output outer ring 46 is in contact with the peripheral surfaces of the rollers 43. The engaging projections 35 of the gear 3 are fitted in engaging recesses 461 (see FIG. 7) on the lower surface of the output outer ring 46 at regular intervals.

In the state in which the driving motor 21 (see FIGS. 2 and 4) is not actuated and thus the input shaft 42 of the clutch 4 is not in operation, the holding member 44 is positioned as shown in FIG. 8 by the ring-shaped spring 47 and each roller 43 is positioned at the center of each peripheral plane 42*a* of the input shaft 42 as previously described. In this state, each roller 43 is rotatable and in contact with each peripheral plane 42*a* and the inner peripheral surface of the output outer ring 46, so the output outer ring 46 is rotatable clockwise and counterclockwise. Upon actuation of the driving motor 21, the input shaft 42 rotates clockwise (as shown by the arrow of FIG. 8) relative to the cylindrical wall 441 of the holding member 44 while the input shaft 42 is deforming the ring-shaped spring 47 so that one end portion 471 of the ring-shaped spring 47 approaches the other end portion 472 thereof. As a result, each roller 43 diverges from the center of each peripheral plane 42*a*, and the interval between each peripheral plane 42*a* and the inner peripheral surface of the output outer ring 46 becomes shorter. Therefore, each roller 43 is sandwiched between each peripheral plane 42*a* and the inner peripheral surface of the output outer ring 46, thus being locked therebetween. Consequently, the output outer ring 46 is connected to the input shaft 42, thus rotating clockwise together with the input shaft 42. With rotation of the output outer ring 46 faster than the input shaft 42 as will be described in greater detail below, the ring-shaped spring 47 is restored to its original shape and thus each roller 43 is returned to the center of each peripheral plane 42*a*. As a result, the output outer ring 46 is disconnected from the input shaft 42, thus being capable of rotating clockwise freely.

The operation of the automatic closer having the construction is described below.

In closing the rear door (D), the switch 12 is operated to actuate the driving motor 21 through the use of an unshown motor control circuit. As a result, the input shaft 42 of the clutch 4 is rotated clockwise. Consequently, the output outer ring 46 is operatively connected to the input shaft 42 through the rollers 43, thus rotating clockwise together with the gear 3. Thus, the gear 5 and the pulley 6 rotate counterclockwise. As a result, the connection wire 1 is wound on the spiral groove 67 of the pulley 6, thus gradually pivoting the rear door (D) in the closing direction. When the rear door (D) is pressed downward by an operator's hands to rapidly close it when the rear door (D) has swung in the closing direction to some extent, the connection wire 1 will be loosened. At this time, the pulley 6 being urged counterclockwise by the power spring 64 is rotated rapidly, thus winding the connection wire 1 thereon and taking up the slack of the connection wire 1. Due to the rapid counterclockwise rotation of the pulley 6 (and gear 5), the gear 3 and the output outer ring 46 rotate clockwise faster than the input shaft 42. As a result, as described previously, the output outer ring 46 is disconnected from the input shaft 42, thus rotating freely. When the rear door (D) is approaching the lower end in its pivotal range, the press-up force of the damper (P) does not effectively slow the motion of the door (D). Thus, the rear door (D) swings rapidly downward due to its own weight. At this time, the pulley 6 is rotated at high speed by the power spring 64, thus winding the connection wire 1 thereon and preventing it from being loosened.

When the rear door (D) is opened, the driving motor 21 is not energized. Therefore, the connection wire 1 can be freely fed from the pulley 6.

Second Embodiment

Figure 10:
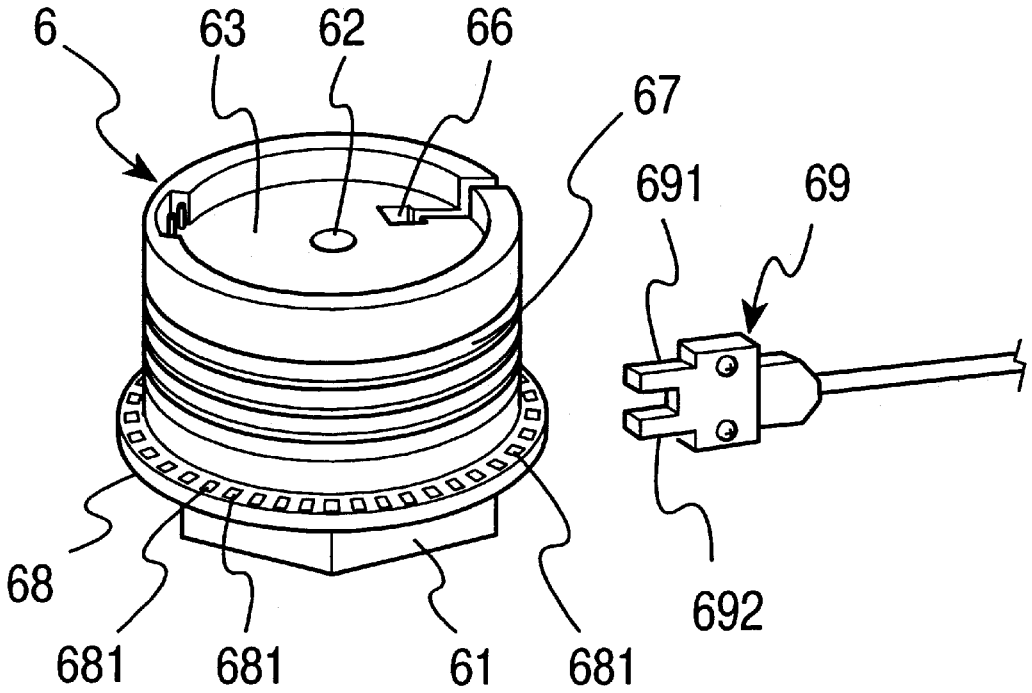
FIG. 10 is a perspective view of an entire pulley according to a second preferred embodiment of the present invention.

In a second preferred embodiment: of the present invention, the switch 12 for closing the rear door (D) of the first embodiment is not used. FIG. 10 shows the pulley 6 of the second embodiment. A ring plate 68 made of black resin constituting a rotation detection means is fixed to the periphery of the pulley 6. A large number of transparent holes 681 are in the periphery of the ring plate 68 at regular intervals. A pair of projections 691 and 692 spaced at a certain interval vertically are at the front of an optical sensor 69 to sandwich the periphery of the ring plate 68 therebetween. When a transparent hole 681 is coincident with the projections 691 and 692, light emitted by a light emitting element inside the projection 691 passes through the transparent hole 681, thus illuminating a light receiving element inside the projection 692. The optical sensor 69 outputs pulse signals to an unshown motor control circuit each time the transparent hole 681 becomes coincident with the projections 691 and 692. In this manner, the rotation of the ring plate 68, and more particularly, the rotation of the pulley 6, can be detected. The construction of the automatic closer of the second embodiment, other than the construction of the pulley 6, is similar to that of the first embodiment.

In the above-described automatic closer, when the rear door (D) is pressed in the closing direction by an operator's hands, the pulley 6 being urged by the power spring 64 rotates, thus winding the connection wire 1 thereon. The start of the rotation of the pulley 6 is detected by the optical sensor 69. The motor control circuit actuates the driving motor 21 to rotate. That is, in the second embodiment, when the rear door (D) is pressed downward, the driving motor 21 is actuated and the rear door (D) is automatically closed. Therefore, it is unnecessary to provide the switch 12 for closing the door.

Third Embodiment

Figure 11:
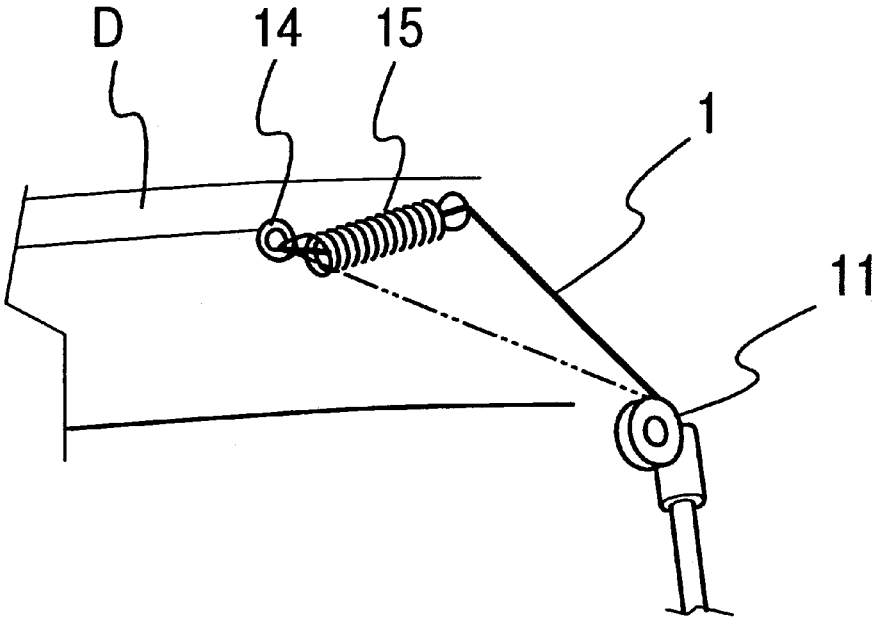
FIG. 11 is a perspective view of a connection wire extending from a connected portion of a rear door to a guide roller according to a third preferred embodiment of the present invention.

FIG. 11 shows a part of the connection wire 1 extending from the wire-connected portion of the rear door (D) to the guide roller 11 proximate to the edge of the rear opening (O) of the vehicle body according to a third preferred embodiment of the present invention. A coil spring 15 serving as a guide member is on a fixed bracket 14 for accommodating the connection wire 1 extending from the wire-winding device 2 (see FIG. 1) to the rear door (D). The coil spring 15 accommodating the connection wire 1 forms a certain angle with the linear locus (shown by double dot-dash line) of the connection wire 1 extending from the fixed bracket 14 to the guide roller 11, thus causing the connection wire 1 to greatly extend sideways. It is preferable that the coil spring 15 extends away from the periphery of the rear opening (O). The construction of winding the connection wire 1 is similar to that of the first embodiment.

Figure 12:
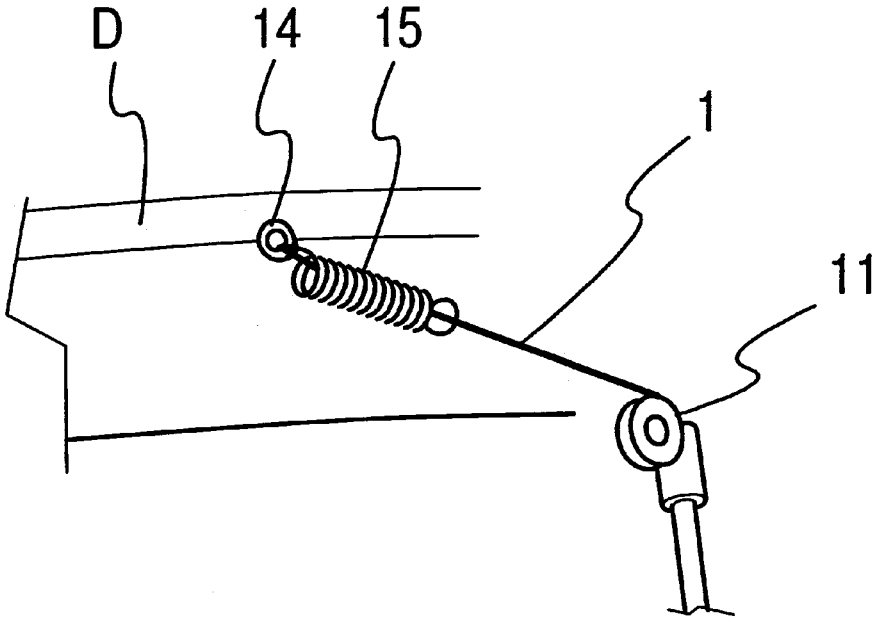
FIG. 12 is a perspective view of the connection wire extending from the connected portion of the rear door to the guide roller according to the third embodiment.

When the rear door (D) is automatically closed, a tensile force is applied to the connection wire 1, as shown in FIG. 12. Thus, the coil spring 15 is deformed along the linear locus of the connection wire 1. When the rear door (D) swings rapidly due to its own weight in the vicinity of the lower end of its pivotal range, as in the case of the first embodiment, the power spring 64 (see FIG. 6) rotates the pulley 6 at a high speed to wind the connection wire 1 around the pulley 6. If the connection wire 1 is not wound at a high speed, it becomes loose and hence the tensile force is not applied thereto. As a result, the coil spring 15 is restored to its original shape immediately, as shown in FIG. 11, thus tightening the connection wire 1 and preventing the connection wire 1 from being sandwiched between the rear door (D) and the periphery of the rear opening (O). It is particularly effective that the coil spring 15 is installed on the rear door (D) so it is directed away from the periphery of the rear opening (O) to prevent the connection wire 1 from being sandwiched between the rear door (D) and the periphery of the rear opening (O). After the rear door (D) is closed, the driving motor drives the pulley 6 to wind the connection wire 1 thereon. As a result, the tensile force is applied to the connection wire 1 again. Consequently, the coil spring 15 is deformed along the linear locus of the connection wire 1, as shown in FIG. 12.

Fourth Embodiment

Figure 13:
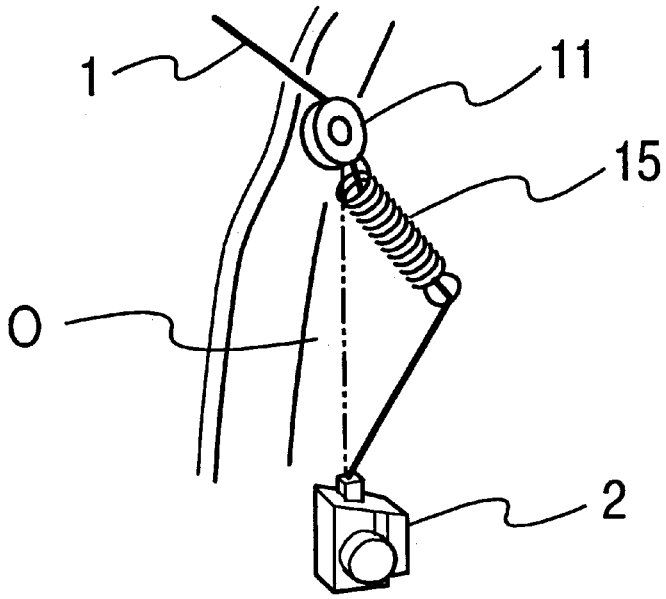
FIG. 13 is a perspective view of a connection wire extending from a wire-winding device to a guide roller according to a fourth preferred embodiment of the present invention.

In a fourth preferred embodiment of the present invention, the coil spring 15 is installed at a position different from that of the third embodiment, as shown in FIG. 13. FIG. 13 shows the connection wire 1 extending from the guide roller 11 on the rear part of the vehicle body proximate to the periphery of the rear opening (O) to the wire-winding device 2. The coil spring 15 accommodating the connection wire 1 and the guide roller 11 are held together as a unit. The coil spring 15 forms a certain angle with the linear locus (shown by the double dot-dash line) of the connection wire 1 extending to the wire-winding device 2, thus causing the connection wire 1 to greatly extend sideways. It is preferable that the coil spring 15 extends outward and sideways from the periphery of the rear opening (O). The construction of winding the connection wire 1 is similar to that of the first embodiment.

Figure 14:
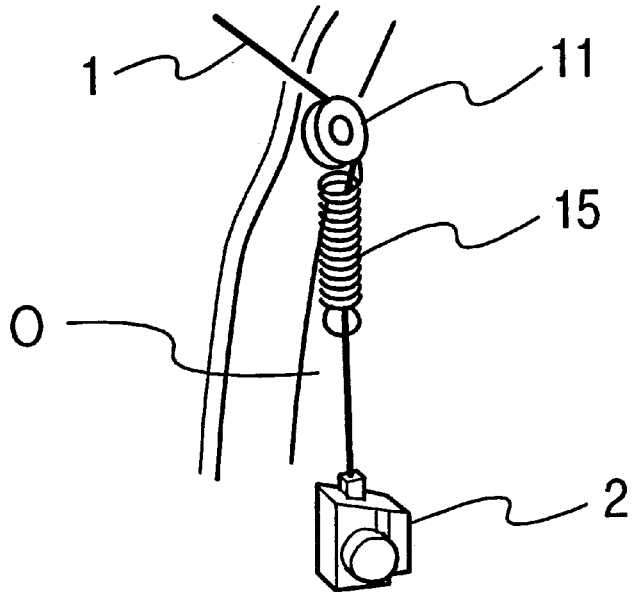
FIG. 14 is a perspective view of the connection wire extending from the wire-winding device to the guide roller according to the fourth embodiment.

When the rear door (D) is automatically closed by the driving motor 21 (see FIG. 2), a tensile force is applied to the connection wire 1, as shown in FIG. 14. Thus, the coil spring 15 is deformed along the linear locus of the connection wire 1. When the rear door (D) swings rapidly due to its own weight in the vicinity of the lower end of its pivotal range, as in the case of the first embodiment, the power spring 64 (see FIG. 6) rotates the pulley 6 at a high speed to wind the connection wire 1 around the pulley 6. If the connection wire 1 is not wound at a high speed, it will become loose and hence the tensile force is not applied thereto. As a result, the coil spring 15 is restored to its original shape immediately, as shown in FIG. 13, thus tightening the connection wire 1 and preventing the connection wire 1 from being sandwiched between the rear door (D) and the periphery of the rear opening (O). It is particularly effective that the coil spring 15 is installed on the rear part of the vehicle body so it is directed outward from the periphery of the rear opening (O) to prevent the connection wire 1 from being sandwiched between the rear door (D) and the periphery of the rear opening (O). After the rear door (D) is closed, the driving motor drives the pulley 6 to wind the connection wire 1 thereon. As a result, the tensile force is applied to the connection wire 1 again. Consequently, the coil spring 15 is deformed along the linear locus of the connection wire 1, as shown in FIG. 14.

Fifth Embodiment

Figure 15:
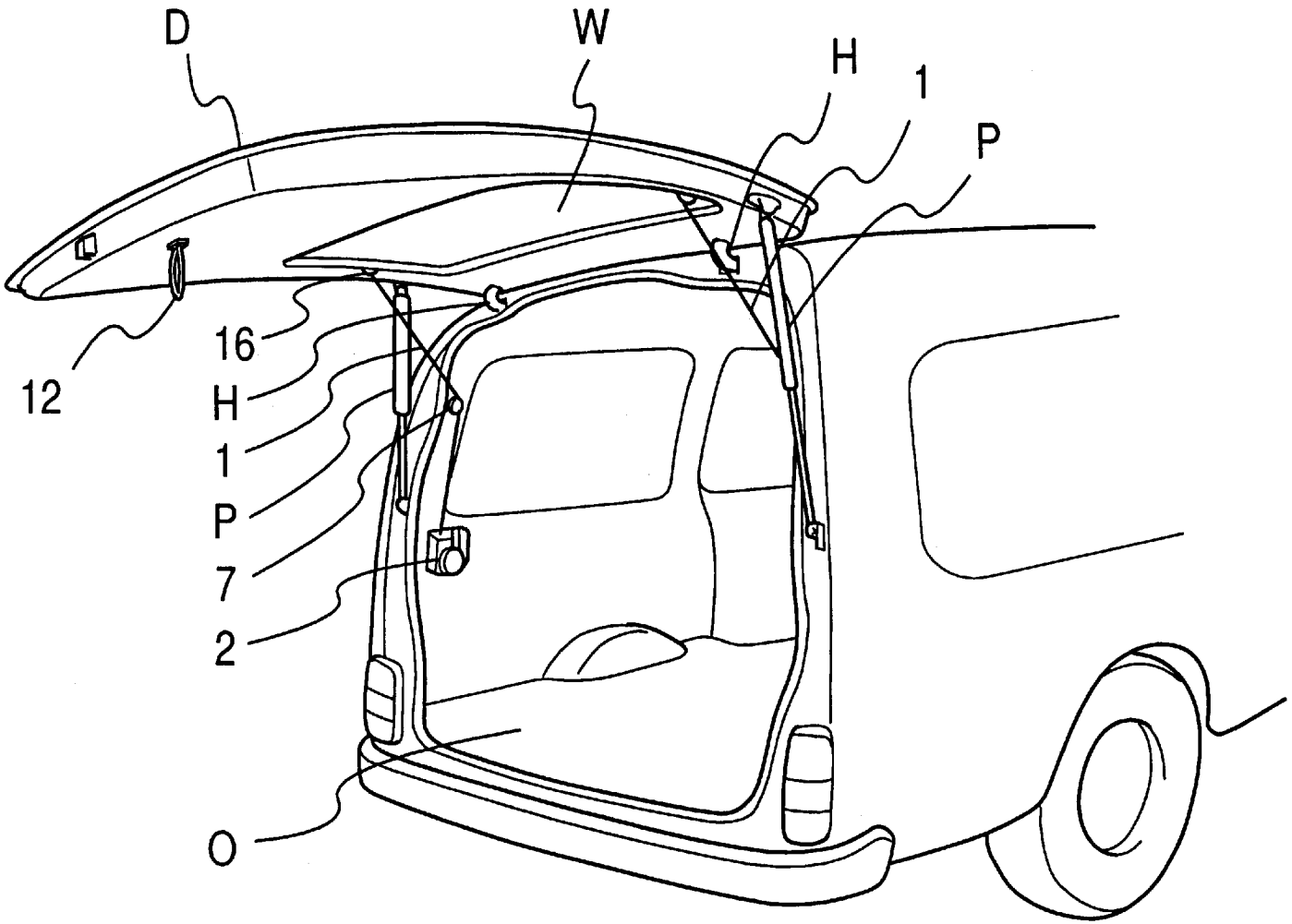
FIG. 15 is a perspective view of the rear part of a van, the rear door of which has been popped up, according to a fifth preferred embodiment of the present invention.
Figure 16:
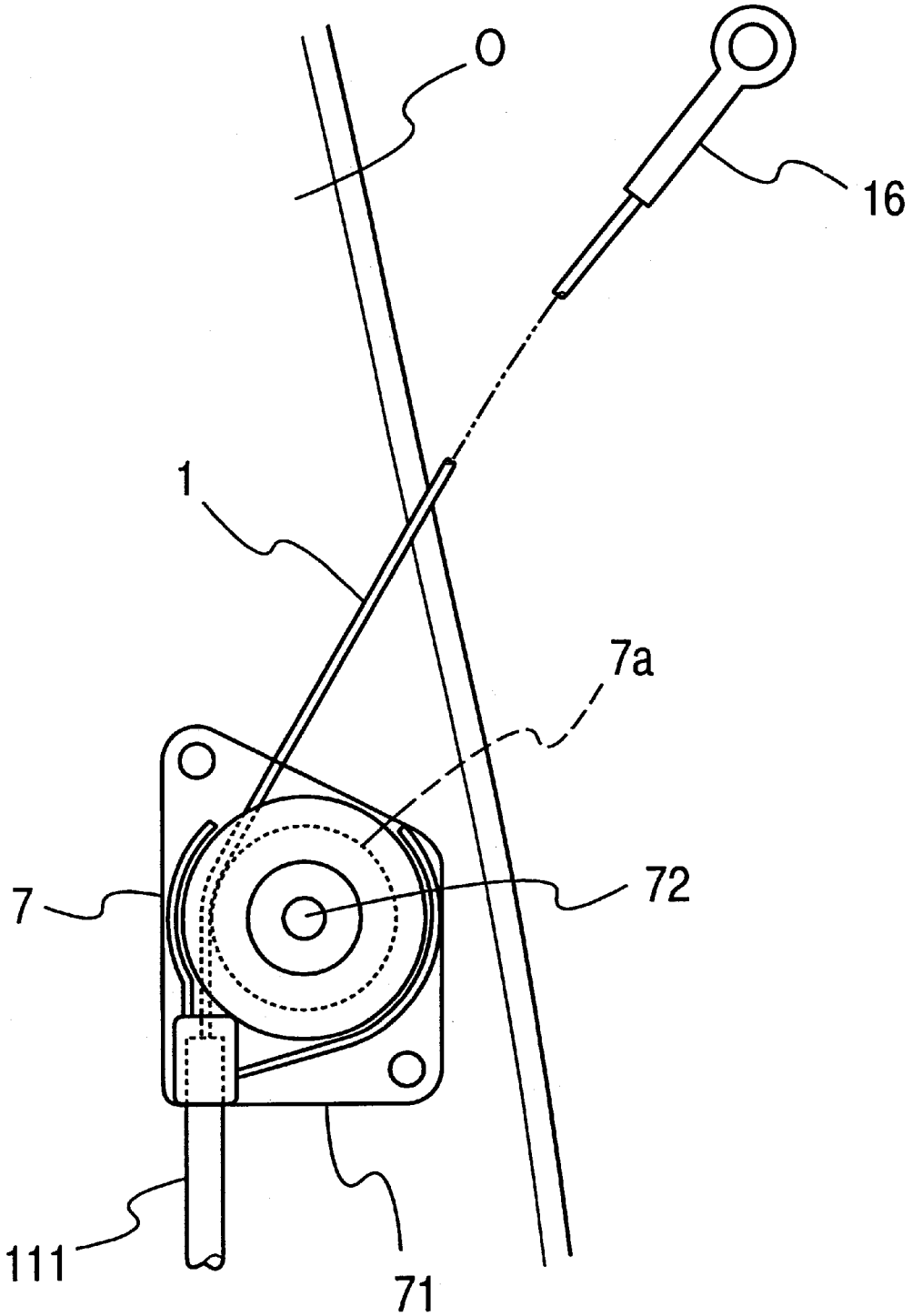
FIG. 16 is a front view of a guide roller according to the fifth embodiment.

FIG. 15 is a perspective view showing a rear part of a van according to a fifth preferred embodiment of the present invention, and FIG. 16 shows the detailed construction of a guide roller-installing portion according to the fifth embodiment. A guide roller 7 is rotatably mounted on a supporting shaft 72 installed on a base 71 fixed to a side periphery of the rear opening (O). The connection wire 1 accommodated in an outer casing 111 extends rearward, upward, and obliquely from a wire-winding device 2 below the guide roller 7 via a peripheral groove 7*a* of the guide roller 7 and is connected to the rear door (D) by a bracket 16 at the from end of the connection wire 1.

Figure 17:
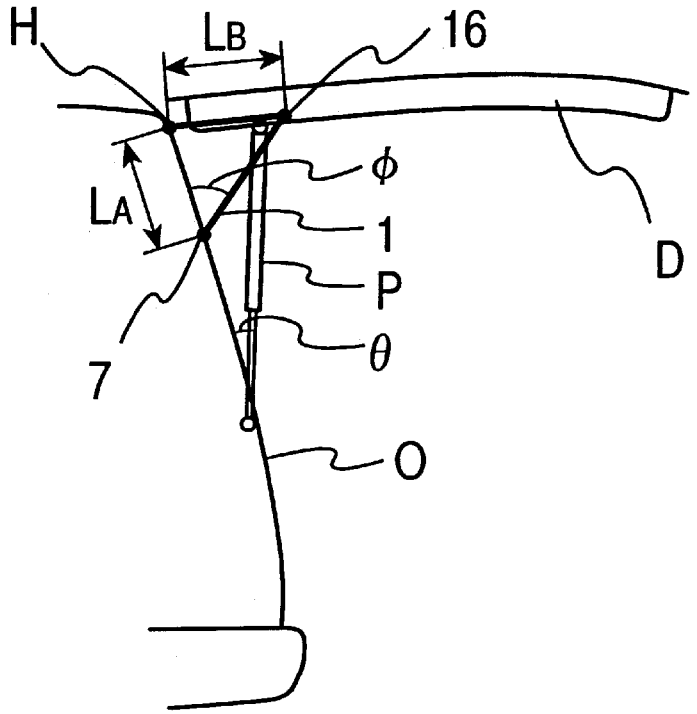
FIG. 17 is a schematic side view of the rear part of the van, the rear door of which has been popped up, according to the fifth embodiment.
Figure 18:
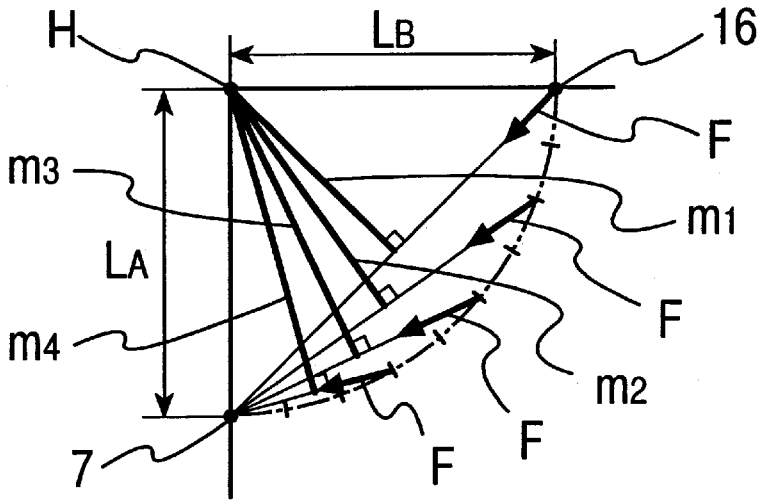
FIG. 18 is an explanatory view of the change in the distance between a hinge-installed position and action lines of wire-pulling forces in the process of closing the door according to the fifth embodiment.

As shown in FIG. 17, when the rear door (D) is opened, the damper (P) extends upward from the side edge of the rear opening (O) to the rear door (D), thus forming an angle $\theta$ with the periphery of the rear opening (O). That is, a triangle having a top angle at the hinge (H) portion of the rear door (D) is formed. As shown in FIG. 17, the guide roller 7 is located above the position at which the lower end of the damper (P) is connected to the periphery of the rear wall of the vehicle body. The connection wire 1 extends to the rear door (D) through the guide roller 7, thus forming an angle $\phi$ with the periphery of the rear opening (O). That is, a triangle having a top angle at the hinge (H) portion of the rear door (D) is formed. The angle $\phi$ is greater than the angle $\theta$. The ratio between two sides of the triangle, namely, the ratio of the length LA between the hinge-installed position and the guide roller 7 to the length LB between the hinge-installed position and the wire-connected position (bracket 16) is set to 1:1. Accordingly, angle $\phi \approx \tan^{-1}(1)=45°$.

When the ratio between the lengths LA and LB is set as above, in the process of closing the rear door (D), the distance between the hinge-installed position and the action line of a wire-pulling force (F) becomes longer in the order of m1 to m4. However, there is a very small variation in the distance. Therefore, the wire-pulling force (F) does not rapidly become great against the turning moment of the damper (P) while the rear door (D) is downwardly swinging. Therefore, the driving motor installed inside the wire-winding device 2 need not have a high output and need not be large. Further, because the fluctuation in the load to be applied to the driving motor is small, the door-closing speed can be prevented from greatly fluctuating.

Figure 19:
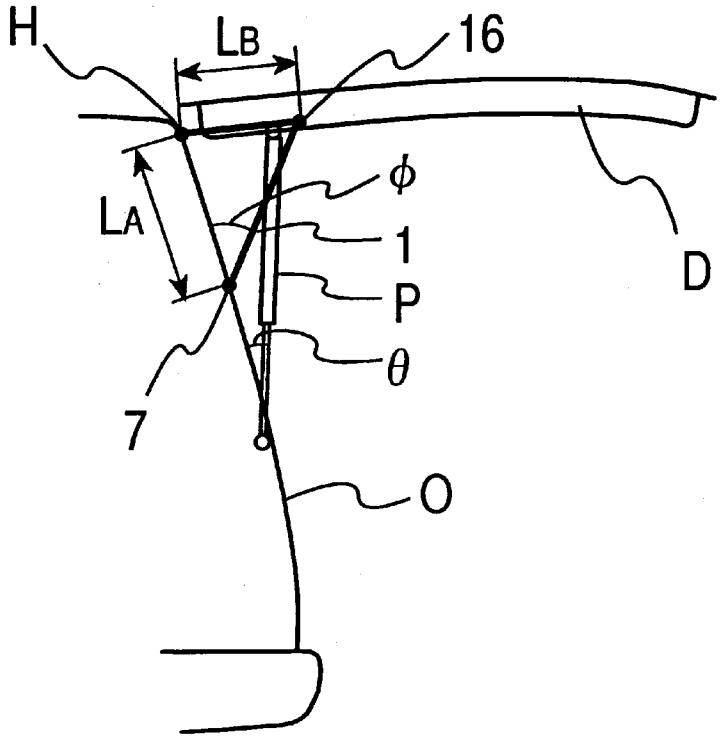
FIG. 19 is a schematic side view of the rear part of the van, the rear door of which has been popped up, according to the fifth embodiment.
Figure 20:
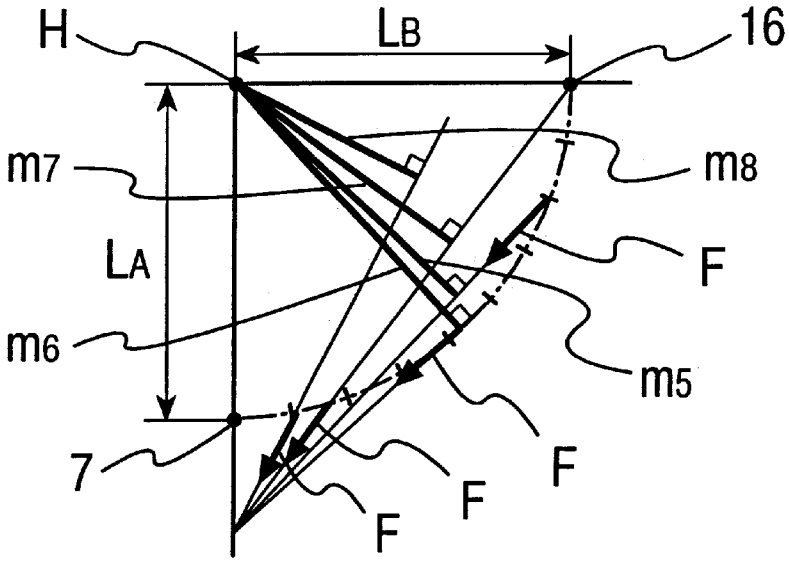
FIG. 20 is an explanatory view of the change in the distance between the hinge-installed position and action lines of wire-pulling forces in the process of closing the door according to the fifth embodiment.

Referring to FIG. 19, the ratio of the length LA to the length LB is set to 4:3. Accordingly, the angle $\phi \approx \tan^{-1}(3/4)$. In the process of closing the rear door (D), the distance between the hinge-installed position and the action line of the wire-pulling force (F) is varied from m5 to m8, as shown in FIG. 20. As indicated in FIG. 20, the change in the distances from m5 to m7 is very small, whereas the distance m8 becomes much shorter than the distances m5, m6, and m7 when the rear door (D) is in the vicinity of the lower end of its pivotal range. However, in the vicinity of the lower end of its pivotal range, the press-up force of the damper (P) does not act effectively and the rear door (D) pivots in the closing direction due to its own weight. Thus, even though the distance m8 is short, the wire-pulling force (F) required to close the rear door (D) does not rapidly increase. That is, the rapid increase in the wire-pulling force (F) required to close the rear door (D) can be avoided by setting the ratio of the distance LA to the distance LB to 1:1–4:3. Consequently, the use of a large driving motor is not required and the fluctuation in the door-closing speed can be effectively prevented. The absolute value of each of the distances LA and LB is selected in consideration of the output of the driving motor.

Figure 21:
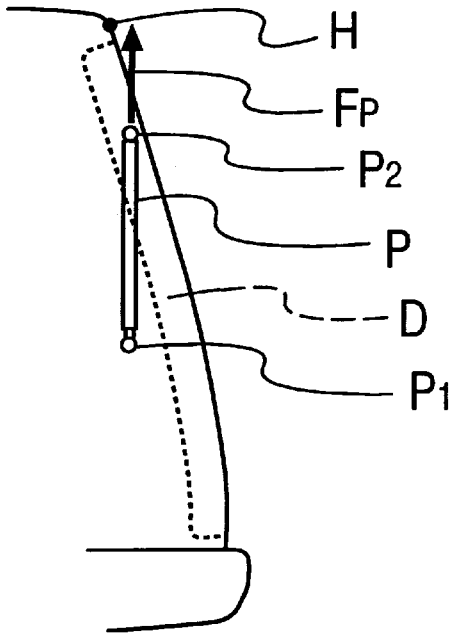
FIG. 21 is a schematic side view of the rear part of the van, the rear door of which has been closed, according to the fifth embodiment.
Figure 22:
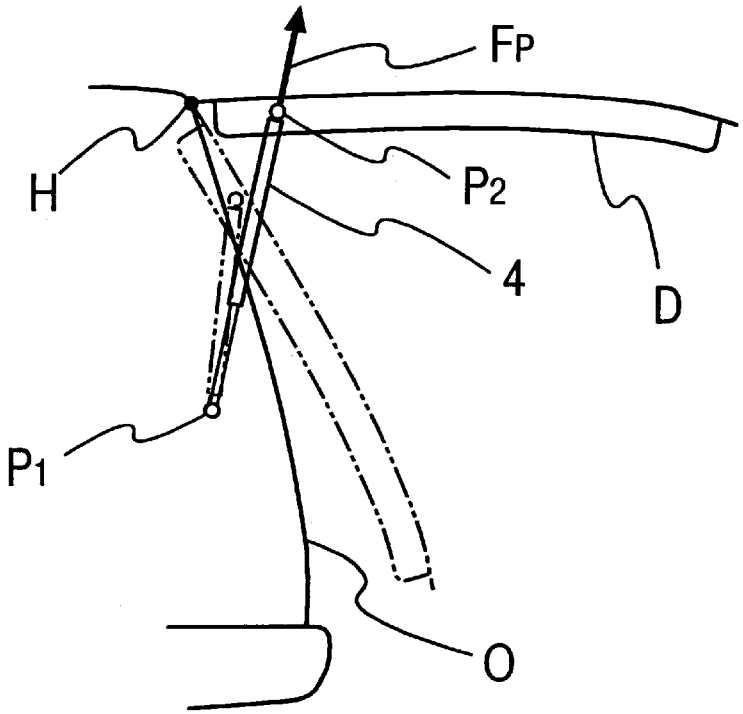
FIG. 22 is a schematic side view of the process of popping up the door and the rear part of the van according to the fifth embodiment.

As shown in FIG. 21, it is preferable that the position of the connection point P1 of the damper (P) on the vehicle body and the connection point P2 thereof on the rear door (D) are so set that in the door-closed state, the extension force FP of the damper (P) generates a moment of pressing the rear door (D) upward at a high degree of force around the hinge-installed position of the vehicle body against its own weight. In this construction, as shown in FIG. 22, the rear door (D) is constantly pressed upward by the damper (P) in the process of completely opening the completely closed rear door (D) . Whatever angle the rear door (D) is opened to, this construction allows the rear door (D) to be operated immediately in the door-opening direction by the pressing force of the damper (P) when the power source of the driving motor is turned off, thus reliably preventing something from being sandwiched between the rear door (D) and the periphery of the rear opening (O). In this case, as described above, the ratio of the length LA to the length LB set to about 1:1 leads to a reduction of the load and fluctuations of the driving motor in the wire-winding device 2.

Other Embodiments

Although the present invention has been fully described in connection with the preferred embodiments thereof with reference to the accompanying drawings, it is to be noted that various changes and modifications will become apparent to those skilled in the art.

For example, in the first embodiment, the clutch 4 is interposed between the pulley 6 and the driving motor 21 to prevent the driving motor 21 from rotating freely when it is energized with electric current. However, the output shaft of a driving motor 21 which rotates freely when the driving motor 21 is not energized can be directly connected to the pulley 6 without interposing the clutch 4 between the pulley 6 and the driving motor 21.

The wire loosening-preventing construction constituted by the coil spring 15 of the third and fourth embodiments is not necessarily used together with wire loosening-preventing construction constituted by the power spring 64 of the first embodiment, and the former can be provided independently of the latter.

To detect rotation of the pulley in the second embodiment, an optical system need not be used, and a magnetic sensor system may be used in its place; alternatively, an arrangement where stationary brushes make contact with electrodes disposed on the pulley may be employed.

Although coil springs were used to prevent loosening of the connection wire in the third and fourth embodiments, other equivalent structures may be used. For example, flexible tubes or strips encircling the connection wires may be used in place of the coil springs. Alternatively, non-flexible members which can pivot at their fixed ends in response to tensile force causing the connection wire to press against the member can be used.

Such changes and modifications are to be understood as being included within the scope of the present invention as defined by the appended claims.

What is claimed is:

1. An automatic closer comprising:

a door, adapted to be attached to a vehicle, to be urged in a door-opening direction;

a connection wire, one end of which is adapted to be connected to a portion of the door for urging in a door-opening direction on the vehicle;

a pulley for winding the connection wire thereon;

a motor for driving the pulley;

a spring member engaging the pulley to force it to rotate in a wire-winding direction; and a clutch, between the pulley and the motor, for allowing free rotation of the pulley when the motor is not energized, and for restricting the rotation of the pulley in a wire-feeding direction relative to the motor rotation when the motor is energized;

wherein the clutch comprises a rotatable input shaft connected to the motor;

an outer ring connected to the pulley; and a plurality of rollers between the input shaft and the outer ring, sandwiched between an outer peripheral surface of the input shaft and an inner peripheral surface of the outer ring only when the input shaft is rotated by the energized motor, thus restricting rotation of the outer ring in a wire-feeding direction relative to the motor rotation.

2. The automatic closer according to claim 1, wherein the spring member includes a power spring disposed along an end surface of the pulley, one end of the power spring being fixed to an end surface of the pulley and the other end thereof being fixed to a member supporting the pulley.

3. The automatic closer according to claim 1, further comprising:

rotation detection means for detecting that the pulley has started to rotate in the wire-winding direction;

wherein the motor is for operating responsive to a detection by the rotation detection means that the pulley has started to rotate.

4. The automatic closer according to claim 3, wherein said rotation detection means comprises:

a light emitting device;

a light detecting device positioned to be illuminated by light from said light emitting device; and a plurality of protrusions disposed around a circumference of the pulley to alternately interrupt light from the light emitting device to the light detecting device.

5. The automatic closer according to claim 1, further comprising:

a guide member for guiding the connection wire in a direction divergent from a linear locus of the wire in the absence of a tensile force applied to the wire in a wire-winding operation and which is moved along the linear locus of the connection wire when a tensile force is applied thereto, the linear locus being a line, extending from a guide pulley to the guide member, on which the connection wire would lie in the absence of guiding by the guide member.

6. The automatic closer according to claim 5, wherein the guide member includes a coil spring through which the connection wire is inserted.

7. The automatic closer according to claim 5, wherein the guide member is elastically deformed along the linear locus of the connection wire when a tensile force is applied thereto.

8. The automatic closer according to claim 5, wherein:

the guide member has a first end adapted to be pivotally fixed relative to one of the vehicle and the door;

the connection wire passes through a volume defined by the guide member; and the connection wire presses against the guide member responsive to a tensile force applied to the connection wire to move the guide member.

9. The automatic closer according to claim 8, wherein:

the first end of the guide member is adapted to be pivotably fixed relative to the door; and the guide member is adapted to be fixed to the door and disposed between the end of the connection wire fixed to the door and a guide roller.

10. The automatic closer according to claim 8, wherein:

the first end of the guide member is adapted to be pivotably fixed relative to the vehicle; and the guide member is fixed to a roller mountable on the body of the vehicle and disposed between the wire winding means and a guide roller.

11. The automatic closer according to claim 1, wherein the door is connecteble to an upper periphery of an opening of the vehicle by a hinge and wherein the door is capable of being pivoted to an open position.

12. The automatic closer according to claim 11, further comprising:

a damper adapted to be disposed between the door and the vehicle body so that the damper can form an angle with the vehicle body to form a triangle having a top angle at a hinge-connected portion of the door, thus popping up the door in a door-opening direction by an extension force thereof;

a guide member, adapted to be disposed on a periphery of an opening of the vehicle, for guiding the connection wire from the periphery of the opening to the door so that the connection wire can form an angle with the vehicle body, greater than an angle formed by the damper with the vehicle body, to form a triangle having a top angle at the hinge-connected portion of the door to suppress fluctuation in a wire-pulling force of the wire-winding means.

13. The automatic closer according to claim 12, wherein the guide member includes a guide roller.

14. The automatic closer according to claim 12, wherein a ratio of a length between the hinge-connected position and the guide member to a length between the hinge-connected position and the connection wire-connected position is set to 1:1–4:3.

15. The automatic closer according to claim 12, wherein the damper is for exerting an urging force for driving the door in the door-opening direction throughout a full range of motion of the door.

16. The automatic closer according to claim 12, wherein the damper is for exerting a substantially vertical upward force on the door when the door is in a closed position.

* * * * *